US008500478B2

(12) United States Patent
Zhang

(10) Patent No.: US 8,500,478 B2
(45) Date of Patent: Aug. 6, 2013

(54) ELECTRICAL CONNECTOR HAVING RENFORCEDD LOCKING PORTION

(75) Inventor: Li-Zhi Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 127 days.

(21) Appl. No.: 13/244,652

(22) Filed: Sep. 25, 2011

(65) Prior Publication Data

US 2012/0094535 A1 Apr. 19, 2012

(51) Int. Cl.
*H01R 4/50* (2006.01)

(52) U.S. Cl.
USPC ..... 439/344

(58) Field of Classification Search
USPC ..... 439/344, 354, 607.4, 607.35, 607.36, 439/607.38, 607.26
See application file for complete search history.

(56) References Cited

U.S. PATENT DOCUMENTS 6,558,197 B1 * 5/2003 Chen et al. ..... 439/607.21
7,645,165 B2 * 1/2010 Wu et al. ..... 439/607.38

FOREIGN PATENT DOCUMENTS

TW 556718 12/2003

* cited by examiner

*Primary Examiner* — Phuong Dinh
(74) *Attorney, Agent, or Firm* — Wei Te Chung; Ming Chieh Chang

(57) ABSTRACT

An electrical connector (100) comprises includes an insulative housing (1) having a receiving space (14), a plurality of terminals (21) retained in the insulative housing (1), a metal retaining portion (3) assembled on the insulative housing (1). The insulative housing (1) comprises includes a pair of block portions (111, 111') extending toward opposite direction directions with each other; and each of the blocking portions has a resisting face (1110). The metal retaining metal (3) includes a reinforced portion (310) arranged behind the blocking portion (111, 111') and attached to the resisting face (1110) of the blocking portion (111, 111'). Therefore, it can prevent the blocking portion (111, 111') of the housing (1) from breaking off during an unexpected situation.

20 Claims, 7 Drawing Sheets

ELECTRICAL CONNECTOR HAVING RENFORCEDD LOCKING PORTION

BACKGROUND OF THE INVENTION

1. Field of the Invention

The present invention relates to a receptacle modular jack connector, and more particularly to a receptacle modular jack having a latch incorporated with a reinforced metallic tab so as to increase rigidity thereof for benefiting miniaturization.

2. Description of the Related Art

TaiWan Utility Pat. No. 566718 issued to Ma et al. on Dec. 11, 2003, discloses a conventional electrical connector including a housing, a number of contacts retained in the housing and a shell covering the housing. The housing has a sidewall with an opening and a pair of latch portions protruding into the opening for locking a mating connector, and the latch portion is integrally formed with the housing by an injection molding process using a liquid plastic as a material, so the latch portion can be broken off easily by the mating connector.

Therefore, an improved electrical connector is desired to overcome the disadvantages of the related arts.

BRIEF SUMMARY OF THE INVENTION

An object of the present invention is to provide an electrical connector with improving strength thereof.

In order to achieve above-mentioned object, an electrical connector comprising: an insulative housing comprising an upper wall, a pair of side walls to together form a receiving space for receiving a plug connector in a mating direction, a plurality of terminals and a metal unit. The upper wall defines an upper opening and a pair of block portions extending toward face to each other in a second direction perpendicular to the mating direction; and each of the blocking portions having a resisting face. And each terminal is retained in the insulative housing and defined a contacting portion extending in the receiving space. The metal unit assembled to the insulative housing. And the metal unit includes a reinforced portion extending in the upper opening and arranged behind the blocking portion in the mating direction and attached to the resisting face of the blocking portion. Therefore with this arranged, the reinforced portion can prevent the blocking portion of the housing from breaking off during unexpected.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
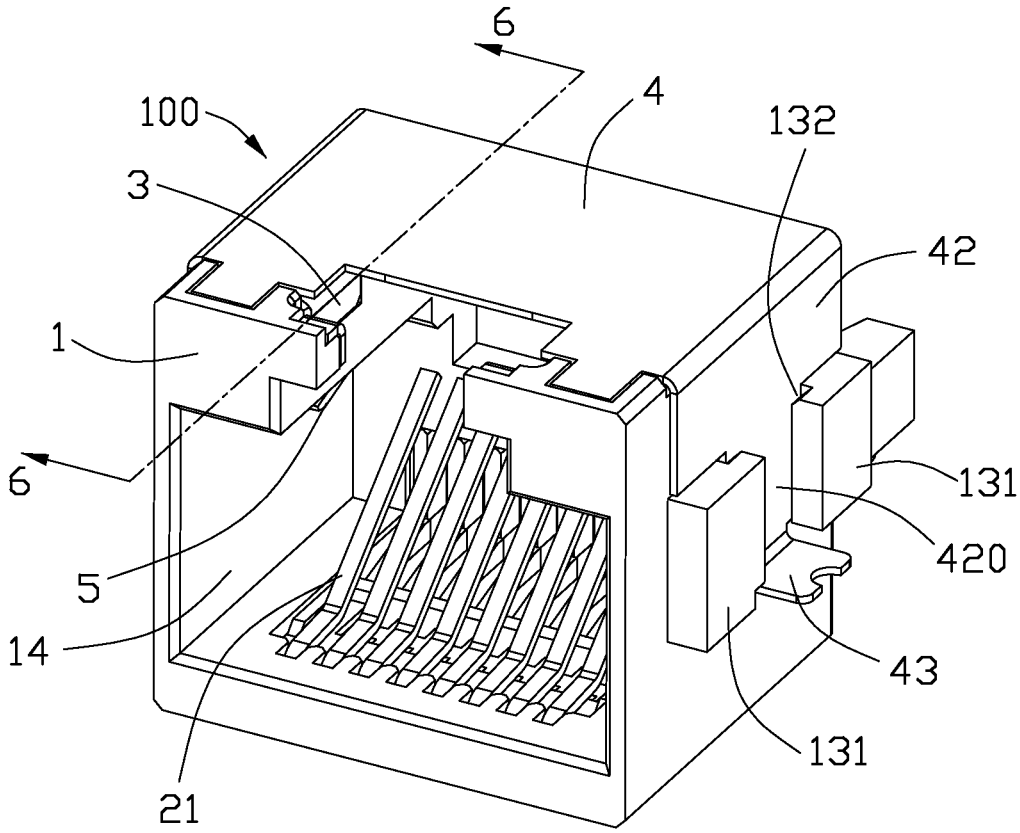
FIG. 1 is a perspective view of an electrical connector in accordance with the present invention.
Figure 2:
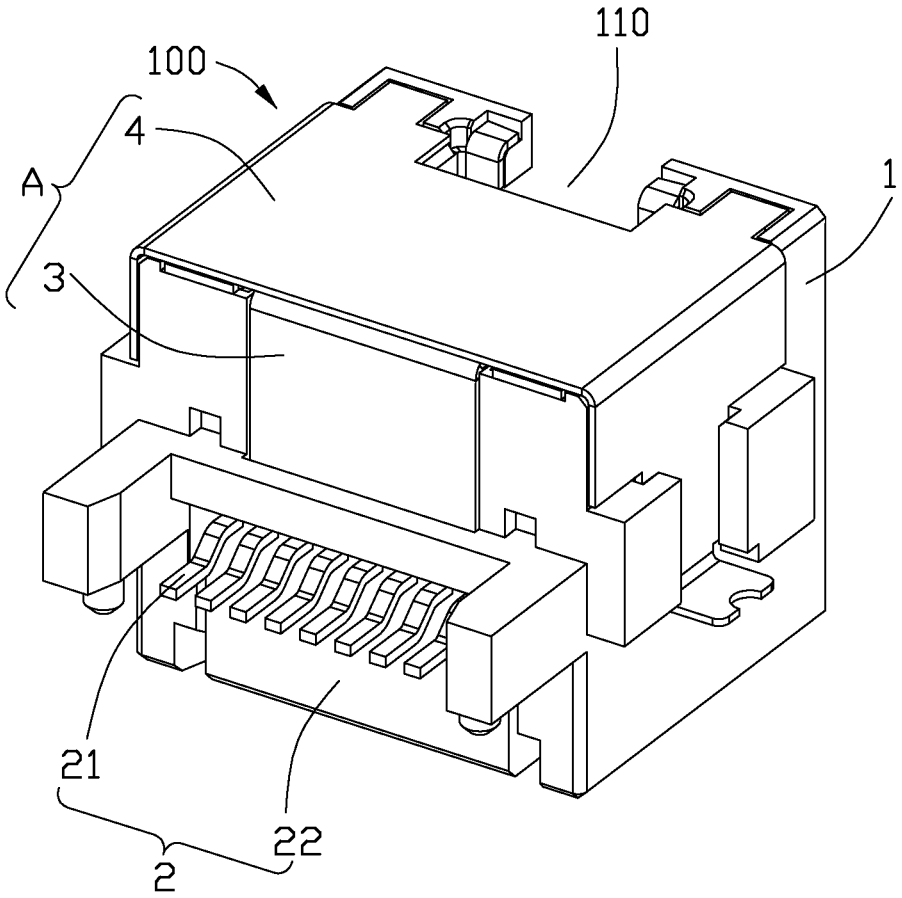
FIG. 2 is another perspective view of FIG. 1.
Figure 3:
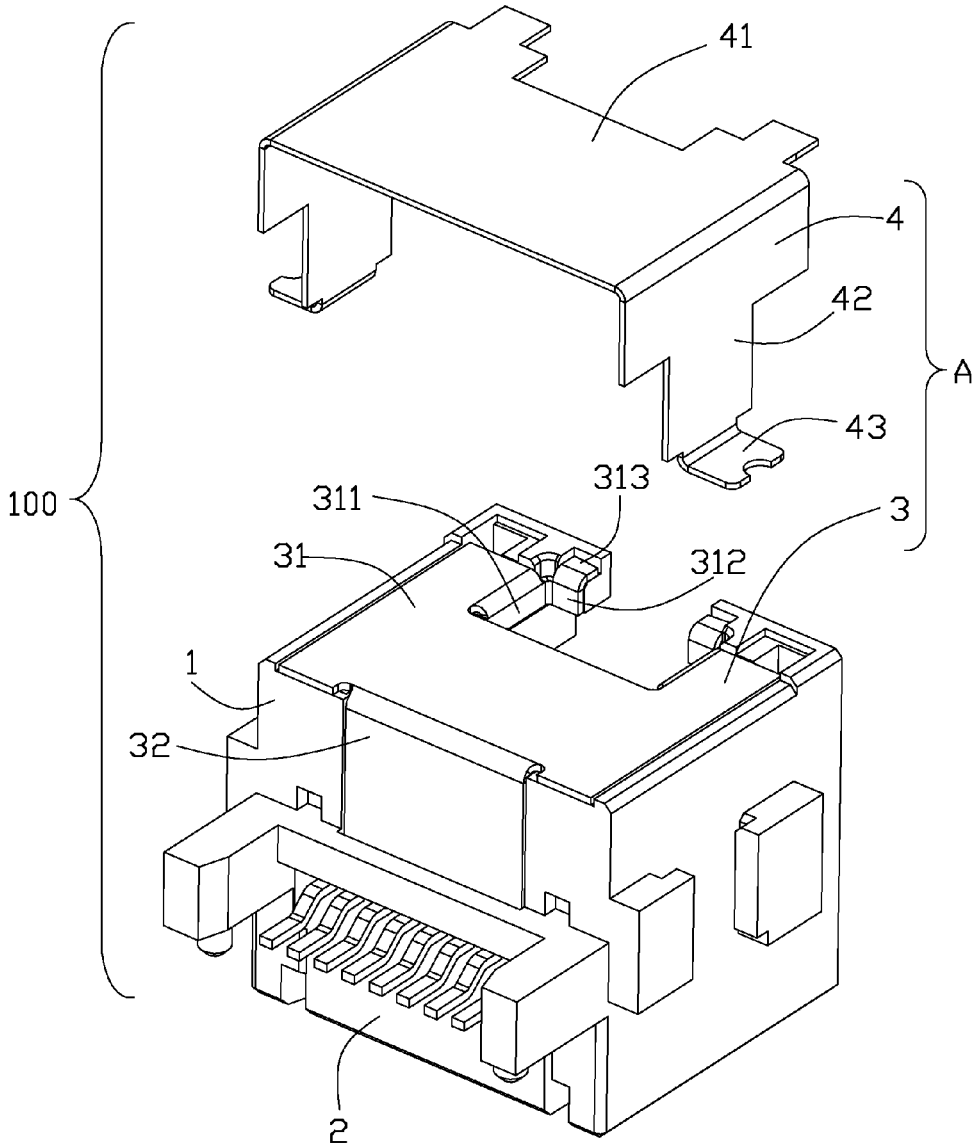
FIG. 3 is a partially exploded view of the electrical connector shown.

Reference will now be made to the drawing figures to describe a preferred embodiment of the present invention in detail. Referring to FIGS. 1 to 3, an electrical connector 100 according to the preferred embodiment of the present invention is provided and comprises an insulating housing 1, a plurality of terminals 21 received in the insulating housing 1, a metal unit A covering on the insulating housing 1 and a pair of anti-mismating members 5 retained the housing 1. In this embodiment, the metal unit A comprises a metal shielding shell 4 and a metal retaining portion 3 sandwiched between the insulative housing 1 and the metal shielding shell 4, and the housing 1 further comprises a base 22, and the plurality of terminals 21 are embedded in the base 22 and formed a terminal module 2.

Figure 4:
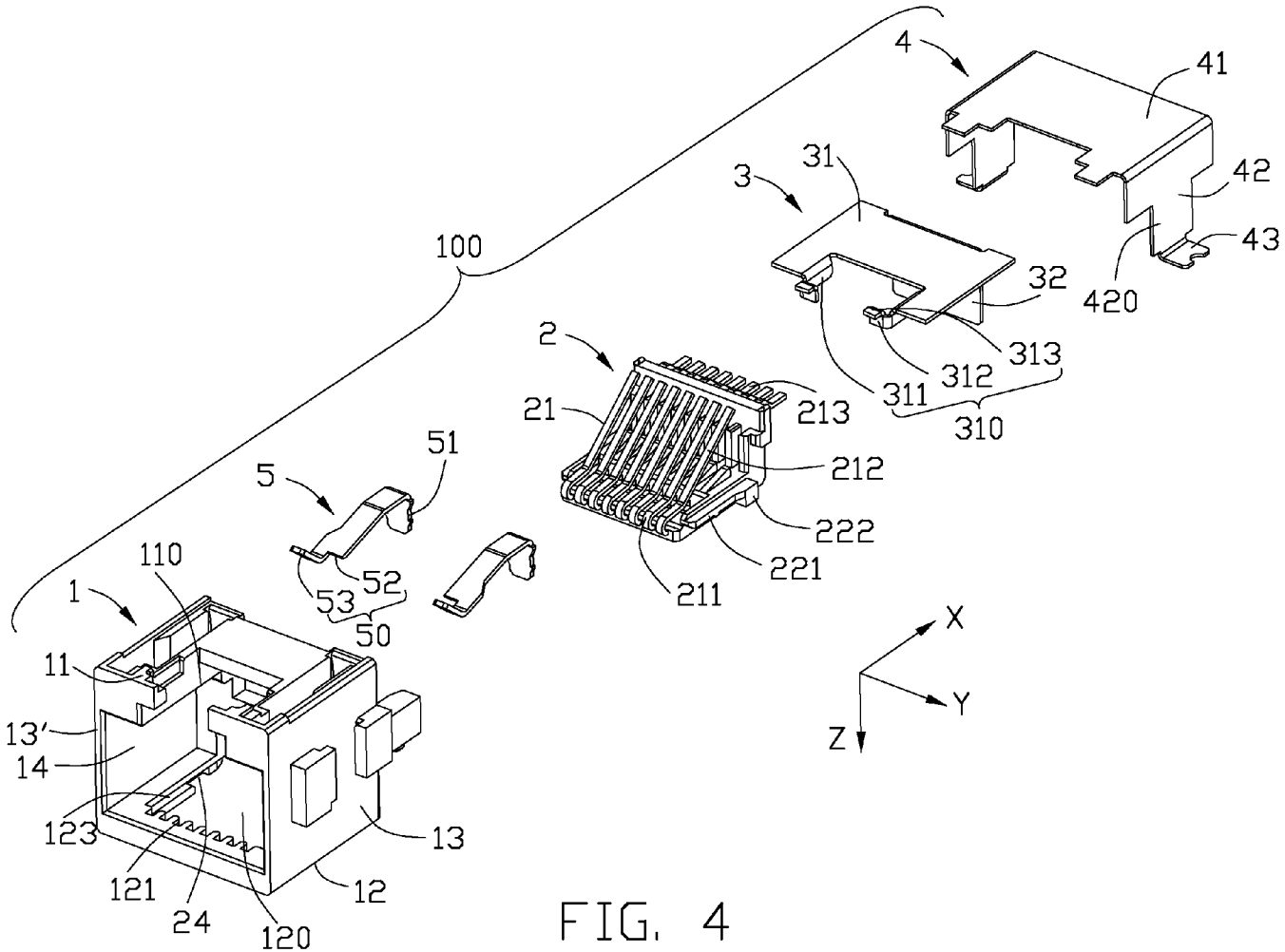
FIG. 4 is an exploded view of the electrical connector shown in FIG. 1.
Figure 5:
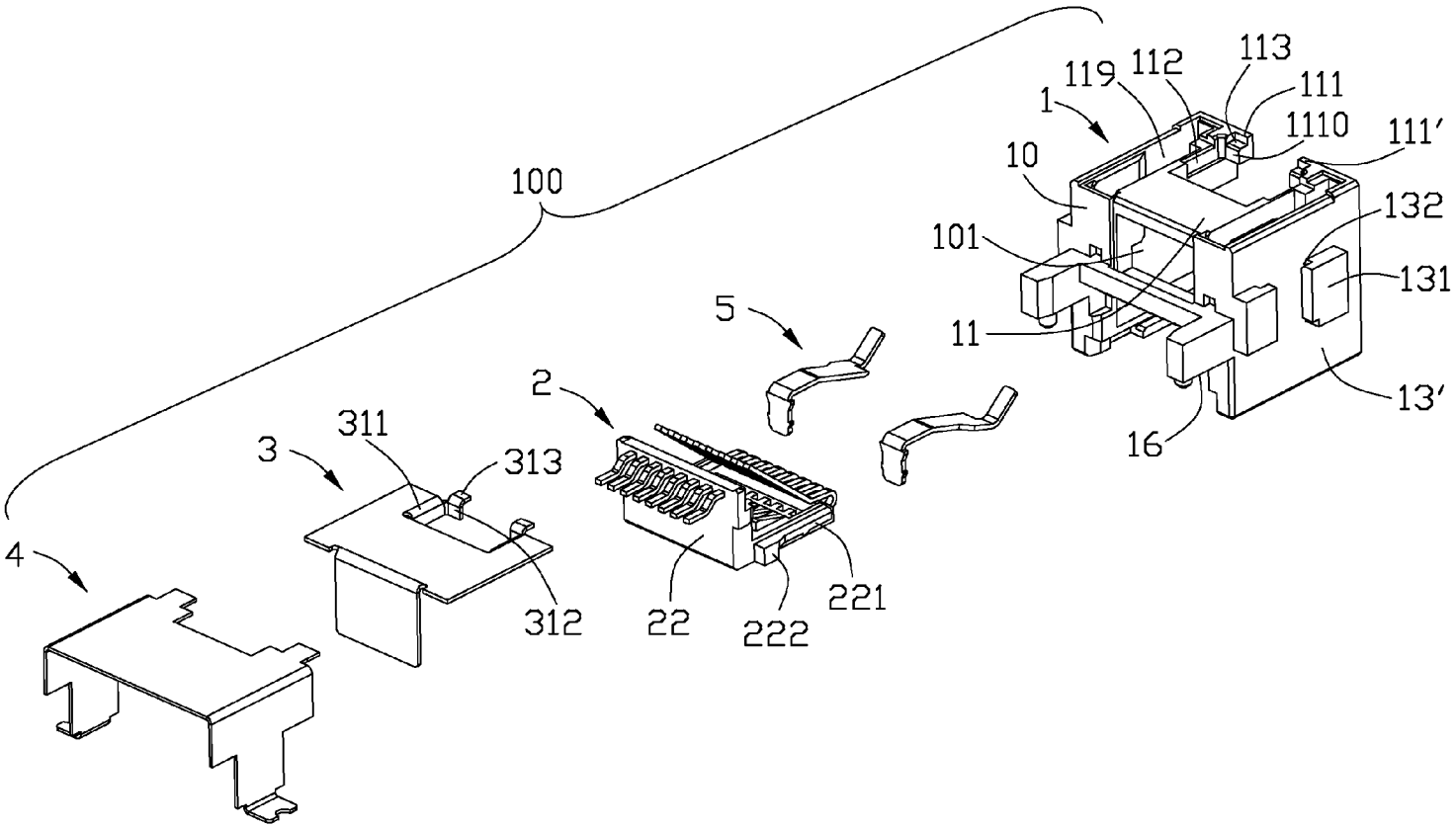
FIG. 5 is another perspective view of FIG. 4.
Figure 6:
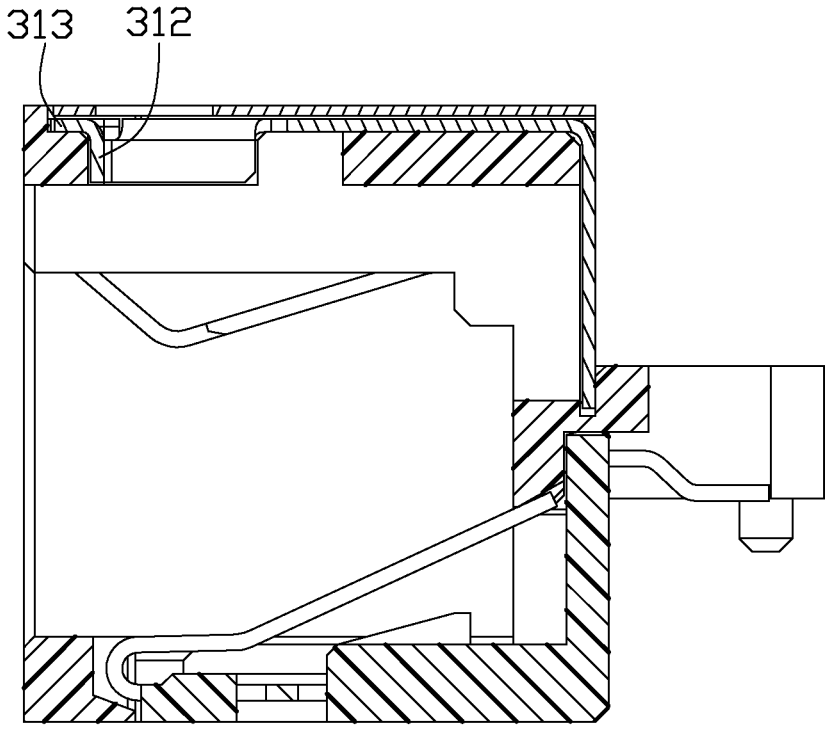
FIG. 6 is a cross-section view taken along a line 6-6 in FIG. 1.
Figure 7:
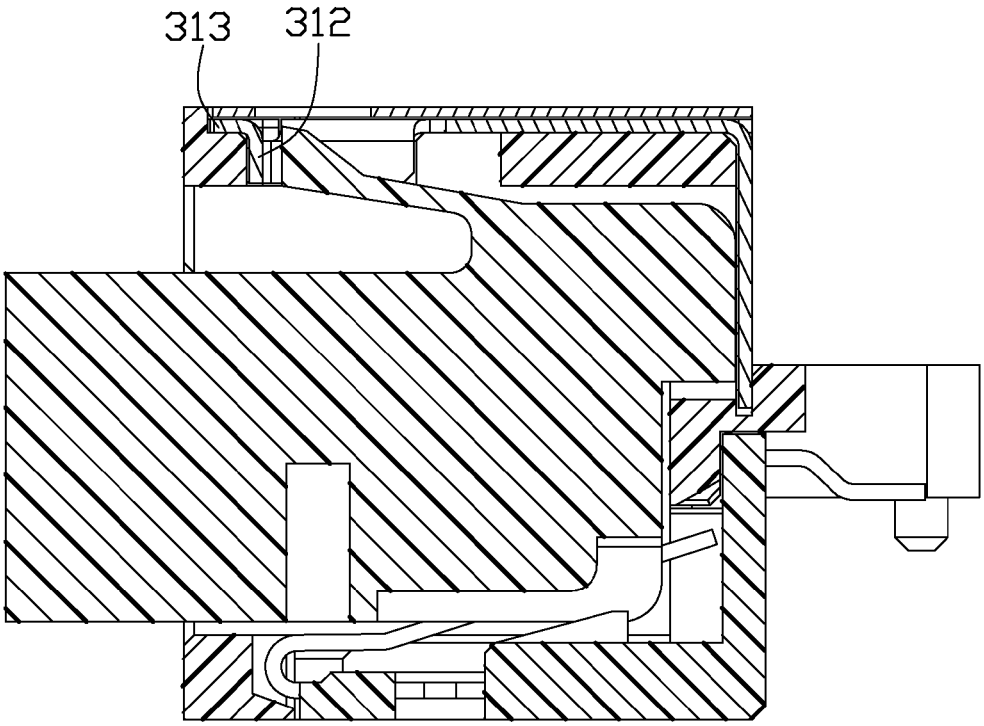
FIG. 7 is another cross-section view of FIG. 6, with a standard plug connector inserted into the electrical connector.

Referring to FIG. 4 and FIG. 5, the insulating housing 1 comprises a rear wall 10, an upper wall 11, a lower wall 12 opposite the upper wall 11, and a pair of side walls 13, 13' interconnecting the upper wall, the lower wall and the real wall and defining a receiving space 14 thereamong for receiving a standard plug connector in a mating direction (X). And the upper wall 11 has an upper opening 110 run through the receiving space 14, and a pair of blocking portions 111, 111' extend in the upper opening 110 and face to each other in a second direction (Y) perpendicular to the mating direction (X), and the upper wall 11 defined a first slot 112 and each the blocking portion 111 has a second slot 113 and run through the upper opening 110 respectively. And each side wall 13 further has a groove 119 run through an upper surface of the upper wall 11 in a third direction (Z) perpendicular to the mating direction and the second direction and the receiving space 14 respectively for receiving the pair of anti-mismating members 5 in the third direction, and the anti-mismating member 5 has a retaining portion 51 for retaining the housing 1 and a spring arm 50 extending slightly downwardly from the retaining portion 51, and a end portion of the spring arm 50 comprises a stopping portion 52 arranged at an inner side thereof and a guiding portion 53 arranged at an outside thereof, so the stopping portion 52 and the guiding portion 53 are set for preventing a unstandard plug connector from entering.

Each the terminal 21 of the terminal module 2 has a retaining portion, a bending spring portion 211 formed at a front of the retaining portion, a contact portion 212 extending obliquely and rearwardly from the bending spring portion 211 at an angle for mating with a corresponding contact of the standard plug connector, and a tail portion 213 extending out of the base 22 for connecting with a layout of a PCB. The lower wall 12 has a lower opening 120 for receiving the terminal module 2, and the lower wall 12 further comprises a number of slots 121 in front thereof for receiving the bending spring portions 211 of the terminals 21 of the terminal module 2, a pair of guiding portions 123 defined at two sides of the lower opening 120 for guiding rib portions 221 of the base 22 of the terminal module 2 inserted thereof and at least one concavity 124 for receiving and engaging with a latch portion 222 of the terminal module 2.

Referring to FIGS. 1 and 4 to 7, The metal retaining portion 3 comprises a body portion 31 for covering the upper surface of the upper wall 11 and a bending portion 32 bent from a side of the body portion 31 for covering a hole 101 of the rear wall 10, and the body portion 31 has a pair of reinforced portions 310 extending in the upper opening 110 of the upper wall 11 for engaging with the standard plug connector, and each the reinforced portion 310 further defines a first bending portion 311 connecting with the body portion 31 and extending downward in the third direction and a second bending portion 312 connecting with a side of the first bending portion 311, and the first bending portion 311 received the first slot 112, and the second bending portion 312 has a curve tip portion 313 received in the second slot 113 of the housing 1, and the second bending portion 312 arranged behind the blocking portion 111 of the housing 1 and attached to a resisting face 1110 of the blocking portion 111. So with this arranged, the standard plug connector against the reinforced portion 310 which can prevent the blocking portion 110 of the housing 1 from breaking off during unexpected.

Referring to FIGS. 1 and 4, the shielding shell 4 defines a top piece 41, a pair of T-shaped side pieces 42 bending downwards from two edges of the top piece 41 and a solder piece 43 bending perpendicularly to the side piece 42 and extending out of the housing 1, the shielding shell 4 encloses the housing with the top piece 41 enclosing the upper wall 11 and the side pieces 42 enclosing the sidewalls 13, so the metal retaining portion 3 is sandwiched between the housing 1 and the metal shielding shell 4. And each the sidewall 13, 13' of the housing 1 comprises a pair of protrusions 131 and each the protrusion 131 defines a channel 132 therein for receiving and retaining the two side edges of the side piece 42. And the real wall 10 of the housing 1 further defines a mounting portion 16 with a mounting surface and coplanar to the mounting surface 43 of the shielding shell 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing comprising an upper wall, a pair of side walls to together form a receiving space for receiving a plug connector in a mating direction, and the upper wall defining an upper opening and a pair of blocking portions extending toward face to each other in a second direction perpendicular to the mating direction; and each of the blocking portions having a resisting face;

a plurality of terminals retained in the insulative housing and comprising a contacting portion extending in the receiving space;

a metal unit assembled to the insulative housing; and the metal unit including a reinforced portion extending in the upper opening and arranged behind the blocking portion in the mating direction and attached to the resisting face of the blocking portion.

2. The electrical connector as described in claim 1, wherein the metal unit further comprising a shielding shell assembled on an outside of the insulative house and a metal retaining portion is sandwiched between the insulative housing and the shielding shell, and the reinforced portion is defined the metal retaining portion.

3. The electrical connector as described in claim 2, wherein the metal retaining portion including a body portion, a first bending portion connecting with the body portion and extending downward in a third direction perpendicular to the mating direction and the second direction, and a second bending portion connects with a side of the first bending portion and extends in the second direction, the first portion and the second portion received into the upper opening, and the reinforced portion is defined the second bending portion.

4. The electrical connector as described in claim 3, wherein the upper wall has a first slot for receiving the first bending portion of the metal retaining portion and each the blocking portion has a second slot for receiving a curve tip portion of the second bending portion.

5. The electrical connector as described in claim 3, wherein the insulative housing has a rear wall and defined a hole thereof, and the metal retaining portion further includes a rear portion bent downwardly from the body portion and covered at a rear side of the hole of the rear wall.

6. The electrical connector as described in claim 1, wherein the insulative housing comprises a base, said terminals are retained in the base thereby forming a terminal module, and the housing further comprising a lower wall defined a lower opening for receiving and retained the terminal module.

7. The electrical connector as described in claim 6, wherein the base of the terminal module has a pair of guiding portion and a latch portion and formed on each side thereof respectively, each side of the lower opening of the lower wall has a guiding groove for receiving the guiding portion of the terminal module and a concavity for receive and engaging with the latch portion of the terminal module.

8. The electrical connector as described in claim 2, wherein each the side wall of the insulative housing has a pair of protrusions and each protrusion defines a channel therein, and the shielding shell has a top piece and a pair of T-shaped side pieces extending downwardly from opposite sides of the top piece respectively, and each of the side pieces is received in the channel and retained between the protrusions.

9. The electrical connector as described in claim 8, wherein the real wall of the insulative housing defines a mounting surface, and the shielding shell has a soldering portion that is coplanar to the mounding surface of the insulative housing.

10. The electrical connector as described in claim 3, wherein the housing defines a groove running through an upper surface of the upper wall, and the electrical connector further comprises a anti-mismating member received and retained in the groove in the third direction, and the anti-mismating member has a retaining portion retained in the housing and a spring arm extending into the receiving space from the retaining portion, and the spring arm comprises a stopping portion arranged at an inner side thereof and a guiding portion arranged at an outside thereof.

11. The electrical connector as described in claim 6, wherein the lower wall of the housing has a plurality of slots in front of the lower opening, and the terminal module comprises a number of bending spring portions received in the slots of lower wall and the contact portions connecting with the bending spring portions.

12. An electrical connector which is matable with a compatible connector, the electrical connector comprising:

an insulative housing defining a front wall with a plug receiving space defined therein, and a top wall having a latch accessible from the front wall and in communication with the plug receiving space; and a metallic shell attached to the top wall and having at least a portion serving as a reinforcement arrangement to the latch.

13. The electrical connector as recited in claim 12, wherein the latch is defined by a first opening and a channel adjacent to the front wall, and a first inner wall of the first opening adjacent to the channel is reinforced with a first reinforcement tab of the metallic shell.

14. The electrical connector as recited in claim 13, wherein a second inner wall adjacent to the first inner wall is also reinforced with a second metallic tab of the metallic shell.

15. The electrical connector as recited in claim 12, further comprising an external shell having mounting tab disposed to a middle of an external wall of the insulative housing.

16. An electrical connector for use with a plug, comprising:

an insulative housing defining a mating cavity forwardly communicating with an exterior via a front opening;

a pair of blocking portions formed by the housing in the front opening to extend laterally toward each other for narrowing a transverse dimension of the front opening thereabouts so as to block a deflectable latch of the plug, each of said pair of blocking portions defining a horizontal exterior plane facing outwardly away from the mating cavity, and a first vertical interior plane rearwardly and inwardly facing the mating cavity, and the housing further defining a pair of second vertical interior planes located proximate the pair of first vertical interior planes and transversely and inwardly facing the mating cavity toward each other;

a plurality of terminals disposed in the housing with deflectable contacting sections exposed in the mating cavity;

a metallic shell defining a main plate covering a face of the housing where the deflectable latch of the plug is adapted to be located around, a pair of vertical bending portions covering the first vertical interior planes of the pair of blocking portions, respectively, for replacing the first vertical interior planes to confront the deflectable latch.

17. The electrical connector as claimed in claim 16, wherein the metallic shell further includes a pair of horizontal bending portions unitarily extending from the pair of vertical being portions and covering the horizontal exterior planes, respectively.

18. The electrical connector as claimed in claim 17, wherein the metallic shell further includes another pair of vertical bending portions covering the pair of second vertical interior planes.

19. The electrical connector as claimed in claim 18, wherein the pair of vertical bending portions extend unitarily from said another pair of vertical bending portions, respectively.

20. The electrical connector as claimed in claim 18, wherein the pair of vertical bending portions, the pair of horizontal bending portions and the another pair of vertical bending portions are perpendicular to one another.

* * * * *